US007222599B2

(12) United States Patent
Waseda

(10) Patent No.: US 7,222,599 B2
(45) Date of Patent: May 29, 2007

(54) ROCKER ARM MADE OF SHEET METAL AND METHOD OF MANUFACTURING THE SAME

(75) Inventor: Yoshitaka Waseda, Nissin (JP)

(73) Assignee: Koyo Seiko Co., Ltd., Osaka-shi, Osaka (JP)

( * ) Notice: Subject to any disclaimer, the term of this patent is extended or adjusted under 35 U.S.C. 154(b) by 0 days.

(21) Appl. No.: 11/018,933

(22) Filed: Dec. 22, 2004

(65) Prior Publication Data

US 2005/0199204 A1 Sep. 15, 2005

(30) Foreign Application Priority Data

Dec. 25, 2003 (JP) ..... P2003-429613

(51) Int. Cl.
*F01L 1/18* (2006.01)

(52) U.S. Cl. ..... 123/90.39; 123/90.45; 123/90.16; 29/888.2

(58) Field of Classification Search ..... 123/90.39, 123/90.45, 90.46, 90.16; 29/888.2
See application file for complete search history.

(56) References Cited

U.S. PATENT DOCUMENTS 5,943,897 A * 8/1999 Tsue et al. ..... 72/335
6,199,527 B1 * 3/2001 Okubo et al. ..... 123/90.41
6,918,170 B2 * 7/2005 Luthi ..... 29/509
2002/0092491 A1 * 7/2002 Kotani et al. ..... 123/90.45

FOREIGN PATENT DOCUMENTS

| | | |
|---|---|---|
| JP | 06-079383 | 3/1994 |
| JP | 2001-55912 | 2/2001 |
| JP | 2001-271614 | 10/2001 |
| JP | 2003-056314 | 2/2003 |
| JP | 2003-328704 | 11/2003 |

OTHER PUBLICATIONS

European Search Report dated May 6, 2005.

* cited by examiner

*Primary Examiner*—Thomas Denion
*Assistant Examiner*—Zelalem Eshete
(74) *Attorney, Agent, or Firm*—McGinn IP Law Group, PLLC

(57) ABSTRACT

A rocker arm includes: a body that is made of sheet metal and includes a pair of side walls; and a pair of axial holes that are respectively formed through the pair of side walls and have a first diameter and through which an axis is inserted. The pair of axial holes include thickened portions formed partially or overall of circumference of the pair of axial holes, and the thickened portion is formed by expanding a hole that has a second diameter smaller than the first diameter and is formed in a pre-arranged range for forming the axial hole in a blank material so as to causing plastic flow in a metallic material of the circumference of the hole.

16 Claims, 4 Drawing Sheets

ROCKER ARM MADE OF SHEET METAL AND METHOD OF MANUFACTURING THE SAME

BACKGROUND OF THE INVENTION

The present invention relates to a rocker arm made of sheet metal for a valve mechanism of an automobile engine, and a method of manufacturing the same.

The rocker arm furnished to the valve mechanism of the automobile engine is provided with a body made of sheet metal, a roller disposed between side walls of the body, and an axis for rotatably supporting the roller via needle rollers. The axis is non-rotatably inserted in axial holes formed in the side walls of the body. A rotation of cam in contact with the roller oscillates the body, and the valve stem is vertically moved in cooperation with this oscillation to open and close a valve (see, for example, Patent Laid Open No. 2001-55912).

The body of the rocker arm receives load from the cam via the roller. In particular, the surrounds of the axial holes through which the axis passing through the body is inserted receives large load. Therefore, for securing rigidity in response to load, the sheet metal having thickness durable against the load is employed for the material of the body, so that the weight of the rocker arm increases by such an amount of the durable thickness.

Further, in general, the axial holes are formed by punching the sheet metal by an amount of the diameter of the axis, and punched circular parts are scrapped as they are, resulting in lowering yield rate.

SUMMARY OF THE INVENTION

In view of above, an object of the present invention is to provide a rocker arm in which weight is reduced, and a desired rigidity is secured.

In order to solve the aforesaid object, the invention is characterized by having the following arrangement.

(1) A rocker arm comprising:

a body that is made of sheet metal and includes a pair of side walls; and a pair of axial holes that are respectively formed through the pair of side walls and have a first diameter and through which an axis is inserted, wherein the pair of axial holes include thickened portions formed partially or overall of circumference of the pair of axial holes, and wherein the thickened portion is formed by expanding a hole that has a second diameter smaller than the first diameter and is formed in a pre-arranged range for forming the axial hole in a blank material so as to causing plastic flow in a metallic material of the circumference of the hole.

(2) The rocker arm according to (1), wherein the thickened portion is formed at a portion of the circumference of the axial hole at sides of loading ranges.

(3) The rocker arm according to (1), wherein only the thickened portion is projected from the side wall in a direction in which the axis is extended.

(4) A method of manufacturing a rocker arm that includes a body that includes a pair of side walls, and a pair of axial holes that are respectively formed through the pair of side walls and have a first diameter and through which an axis is inserted, the method comprising:

forming a hole having a second diameter smaller than the first diameter in a pre-arranged ranges of a blank material; and expanding the hole having the second diameter to form the axial hole having the first diameter so that a thickened portion is formed partially or overall of a circumference of the axial hole by causing plastic flow in a metallic material of the circumference.

(5) A rocker arm that includes a body that includes a pair of side walls, and a pair of axial holes that are respectively formed through the pair of side walls and have a first diameter and through which an axis is inserted, produced by a method comprising:

forming a hole having a second diameter smaller than the first diameter in a pre-arranged ranges of a blank material; and expanding the hole having the second diameter to form the axial hole having the first diameter so that a thickened portion is formed partially or overall of a circumference of the axial hole by causing plastic flow in a metallic material of the circumference.

According to the invention, it is possible to attain reduction in weight, and secure a desired rigidity.

DETAILED DESCRIPTION OF PREFERRED EMBODIMENTS

Figure 1:
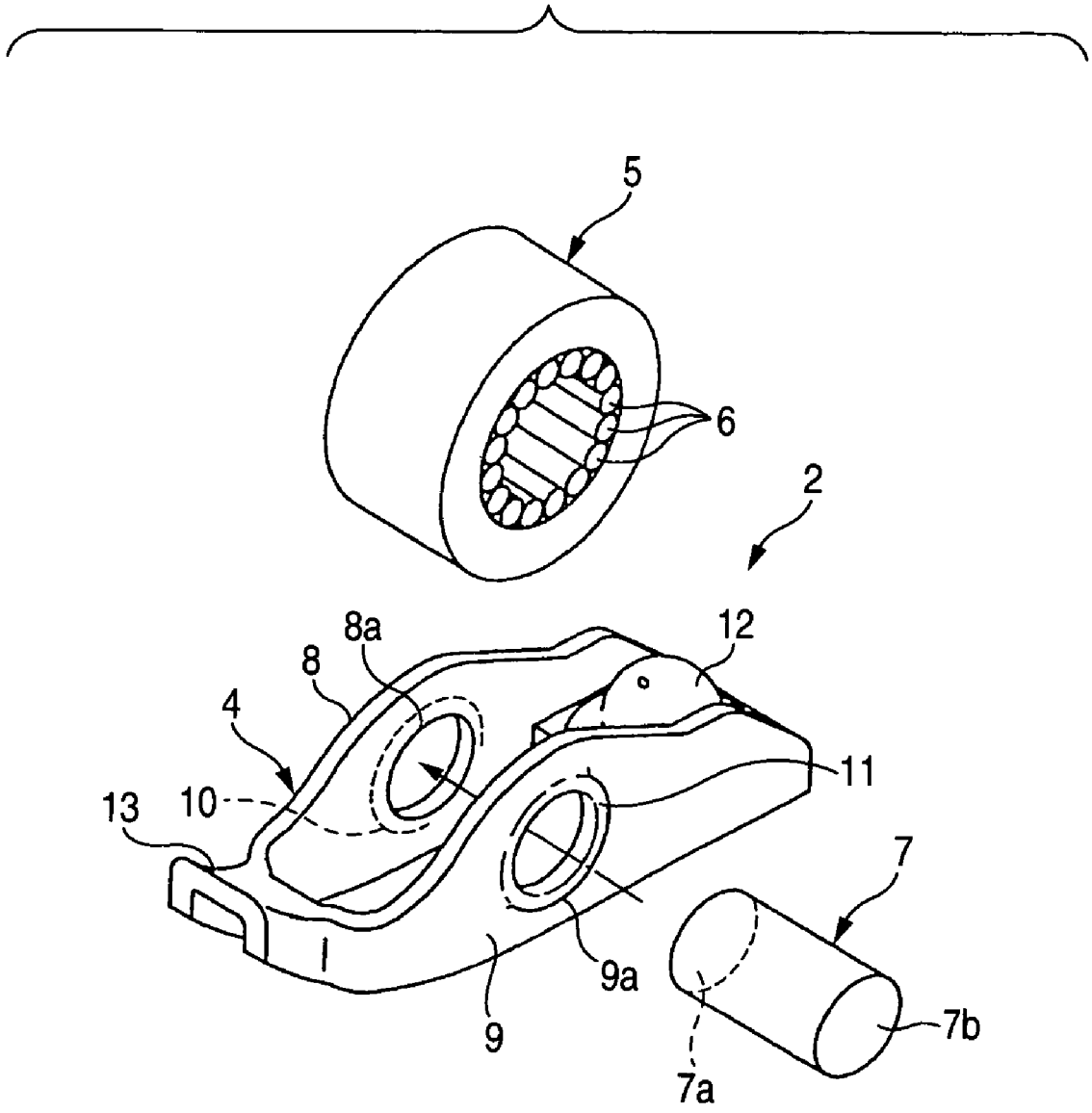
FIG. 1 is a disassembled perspective view of the rocker arm concerned with the most preferred embodiment for practicing the invention.
Figure 2:
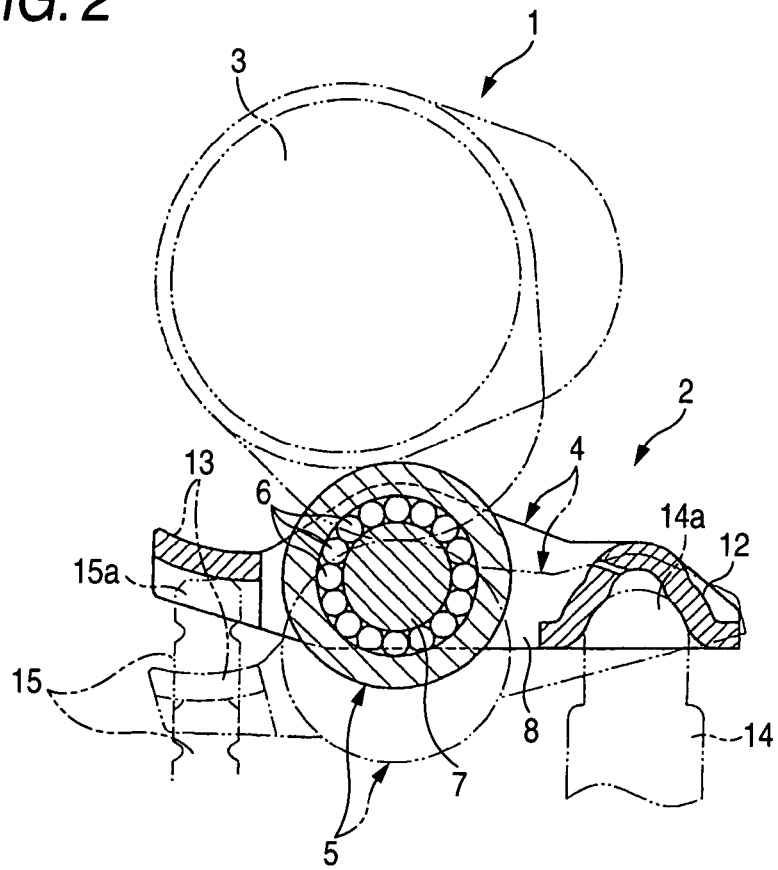
FIG. 2 is a cross sectional view in the central part in the width direction of the rocker arm of FIG. 1.
Figure 3:
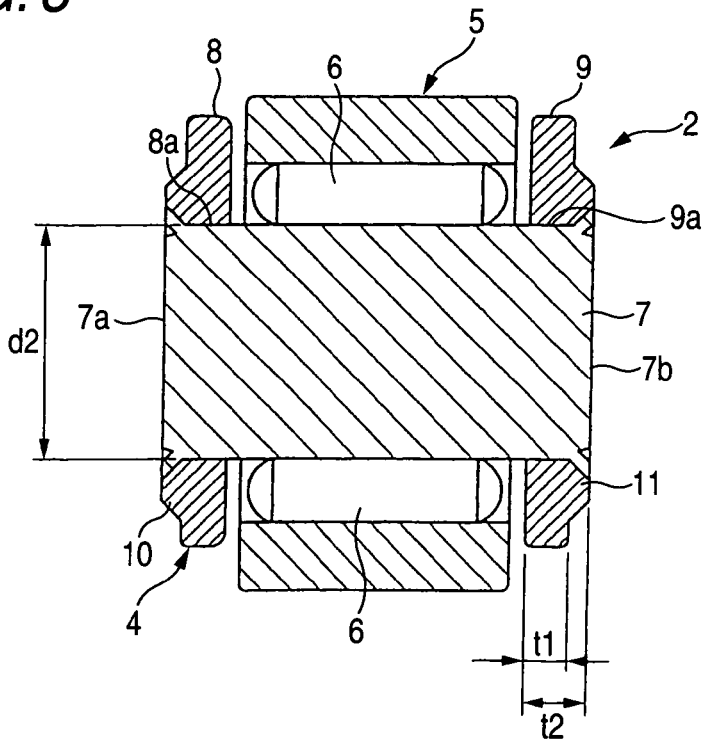
FIG. 3 is a cross sectional view in the central part in the lengthwise direction of the rocker arm of FIG. 1.
Figure 4:
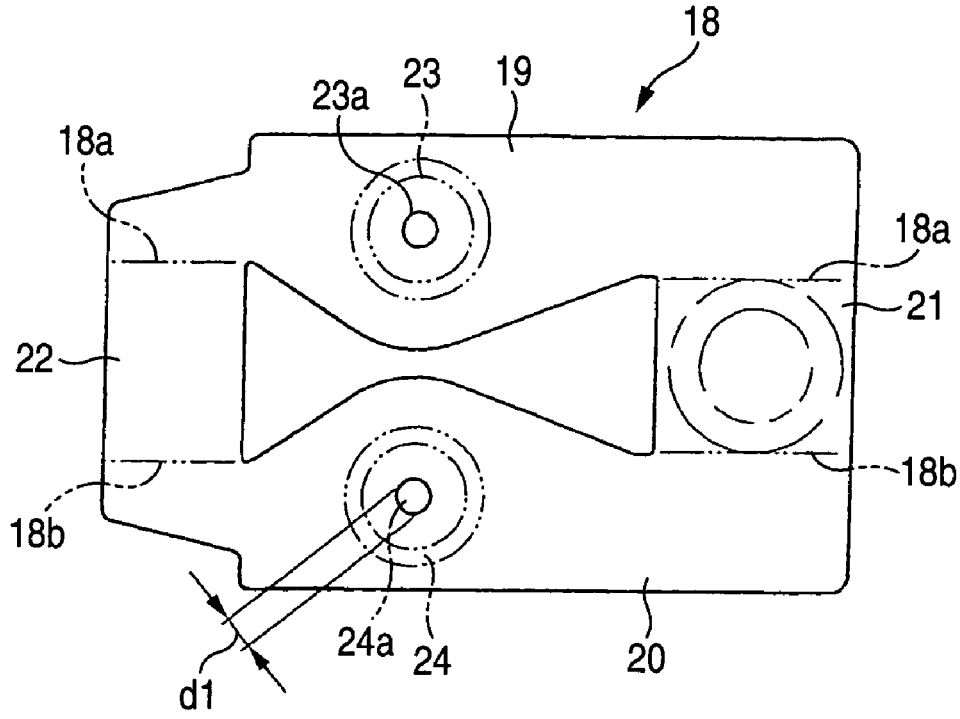
FIG. 4 is a plan view of the blank for making the body of the rocker arm of FIG. 1.
Figure 5:
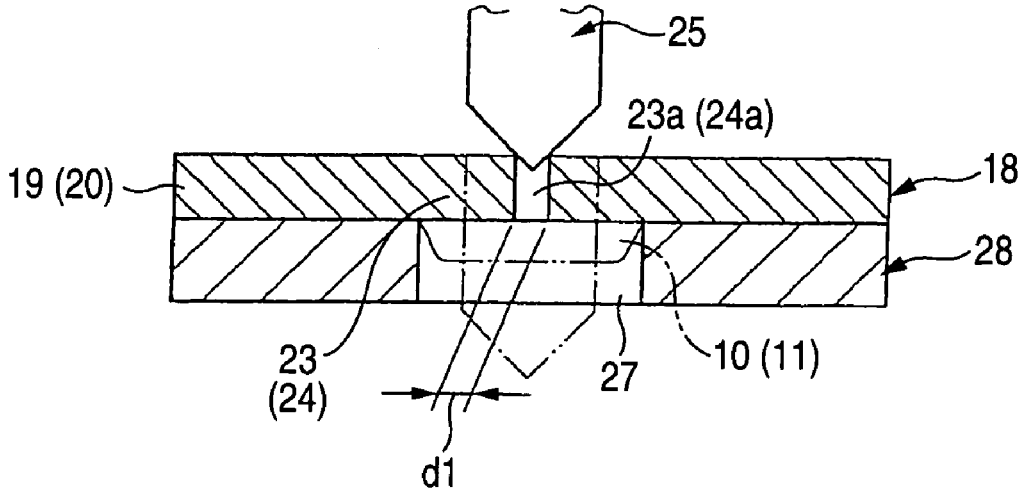
FIG. 5 is a plan view showing the processing procedure of the body of the rocker arm of FIG. 1.

Description will be made to a preferred embodiment according to the invention with reference to the accompanying drawings. FIG. 1 is a perspective view showing the disassembled rocker arm, FIG. 2 is a cross sectional view showing a using condition of the rocker arm, FIG. 3 is a cross sectional view of a central part in the longitudinal direction of the rocker arm, FIG. 4 is a plan view of the blank work, and FIG. 5 is a cross sectional view showing a processing procedure of the body.

Referring to these drawings, reference numeral 1 denotes a cam, and reference number 2 denotes the rocker arm. The cam 1 is rotatably furnished around a cam shaft 3 at a predetermined position of the valve mechanism (not shown). The rocker arm 2 is used to OHC type engine, and is provided with a body 4 made of sheet metal, roller 5, needle rollers 6 turnably disposed at the side of an inner diameter of the roller 5, and an axis 7 inserted at the side of an inner diameter of the needle rollers 6.

The body 4 includes a pair of side walls 8, 9 being parallel to each other. The axis 7 is bridged between both side walls 8, 9 and non-rotatably attached to the side walls 8, 9 by fitting the axis 7 to circumferential faces of the axial holes 8*a*, 9*a* and expanding opposite end faces 7*a*, 7*b* outside in the radial direction.

As one of characteristics of the invention, the outer circumferential portions of the axial holes 8*a*, 9*a* are formed to be thickened portions 10, 11 having thickness t2 larger than thickness t1 of blank materials of opposite side walls 8, 9 constituting the body 4. For example, t2=1.5×t1. Such thickened portions 10, 11 are formed by causing a metallic material to generate plastic flow when forming the axial holes 8*a*, 9*a*.

A lash adjuster carrier 12 is provided between both opposite side walls 8, 9 at one side in the longitudinal direction of the body 4. A lash adjuster 14 slidably fits at its front end to the lash adjuster carrier 12.

A valve carrier 13 is provided between opposite side walls 8, 9 at the other side in the longitudinal direction of the body 4. The valve carrier 13 is incorporated with a front end 15*a* of a valve stem 15. The body 4 is produced by pressing one sheet of metallic sheet, and opposite side walls 8, 9, lash adjuster carrier 12 and valve carrier 13 are formed as one body.

The body 4 of the above structure is made of the sheet metal. In regard to the manufacturing method, the first step is to perform a die-cutting treatment on one sheet of metallic sheet by a pressing process so as to produce a blank material 18 as shown in FIG. 4. This case employs such a metallic sheet being thinner than metallic sheets used to forming of conventional rocker arms.

In FIG. 4, reference numerals 19, 20 denote pre-arranged ranges for forming the side walls 8, 9, reference numeral 21 denotes the pre-arranged range for forming the lash adjuster carrier 12, and reference numeral 22 denotes the pre-arranged range for forming the valve carrier. Reference numerals 23, 24 denote the pre-arranged ranges for forming the axial holes 8*a*, 9*a*. At a stage of this blank material, sizes of diameters d1 of holes 23*a*, 24*a* formed in the pre-arranged ranges for forming the axial holes 8*a*, 9*a* are in advance prepared to be enough smaller than the diameter d2 of the axis 7.

Next, as shown in FIG. 5, the diameter d1 of the holes 23*a*, 24*a* of the pre-arranged ranges 23, 24 is expanded for forming the axial holes 8*a*, 9*a* by means of a suited jig 25. The expansion process is performed under a condition of holding the blank material 18 at its one side on a metal mold 28. The metal mold is formed with a releasing part 27 corresponding to the ranges of the axial holes 8*a*, 9*a*, and the jig 28 is positioned to the holes 23*a*, 24*a* of the pre-arranged ranges 23, 24 for forming axial holes 8*a*, 9*a*, and presses the other side of the blank material 18. By this method, the holes 23*a*, 24*a* are expanded, and the metal material by an expanding amount is effected with plastic flow in order to increase thickness as swelling with respect to the pre-arranged ranges 19, 20 so that thickened portions 10, 11 are formed.

Then, the pre-arranged ranges 19, 20 that form the side walls 8, 9 are bent at the positions shown with imaginary lines 18*a*, 18*b* of FIG. 4 by a determined metal mold (not shown) so as to form the body having the side walls 8, 9, the lash adjuster carrier 12 and the valve carrier 13 as shown in FIG. 1.

Subsequently, a assembly in which the needle rollers 6 are arranged on the inner circumference of the roller 5 is disposed between the side walls 8, 9 as shown in FIG. 1. The axis 7 is inserted from one-side axial hole 9*a* toward the other axial hole 8*a*, and is fitted to the circumferential face of the axial holes 8*a*, 9*a* of the side walls 8, 9 and is expanded at opposite ends 7*a*, 7*b* outside in an axial direction so that the axis 7 is non-rotatably attached to the axial holes 8*a*, 9*a*.

An operation of the rocker arm 2 having the above mentioned structure will be explained with reference to FIG. 2. When the cam 1 rotates under a condition that the cam 1 contacts at its outer circumference to an outer circumference of the roller 5, the roller 5 rotates around the axis 7 in accordance with the rotation of the cam 1, and the body 4 is pushed by the cam 1 from a position of a solid line toward a position of two-dotted line via the roller 5.

Then, the body 4 oscillates around a fulcrum of a front end 14*a* of the lash adjuster 14, whereby the valve stem 15 is vertically reciprocated to open and close the valve of the engine.

In the rocker arm 2 having the above mentioned structure and operation, the axial holes 8*a*, 9*a* secure rigidity at the outer circumference of the axial holes 8*a*, 9*a* in such manners that, when forming the axial holes 8*a*, 9*a*, the metallic material of the blank material is caused with the plastic flow to make the thickened portions 10, 11 thicker than the thickness of the blank material blank metal material of the side walls 8, 9. Therefore, in this rocker arm 2, even if using the material thinner than the blank material of the body of the conventional rocker arm, the cam 1 is enough durable against such load from the cam 1, and as a result, the rocker arm 2 is enough durable in the severely using circumstance of the valve mechanism of the engine, while realizing reduction in weight by using the thin metallic sheet of the body 4.

Further, since the body 4 is formed with the metallic sheet thinner than the conventional ones, and the axial holes 8*a*, 9*a* are formed so that the holes 23*a*, 24*a* are expanded for causing the plastic flow in the thickness of the metallic sheet, an amount of scrapping metal parts is considerably reduced, and accordingly the body 4 of the rocker arm 2 can be heightened in a yield of production.

Figure 6:
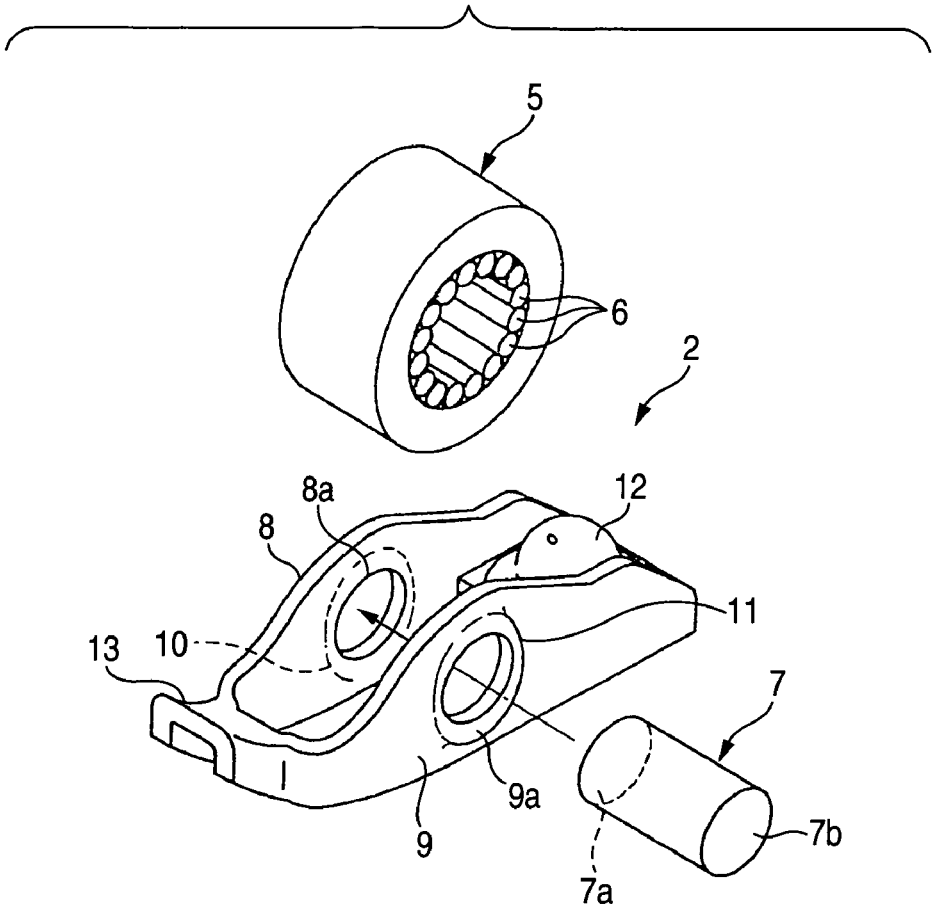
FIG. 6 is a disassembled perspective view of the rocker arm concerned with another embodiment of the invention.

Another embodiment according to the invention will be explained with reference to FIG. 6. In the rocker arm 2 according to this embodiment, the thickened portions 10, 11 of the axial holes 8*a*, 9*a* of the body 4 are formed to be vertically long elliptical in response to the load when serving the rocker arm 2. This rocker arm 2 can also perform similar working effects as that of the rocker arm 2 shown in FIGS. 1 to 3.

Figure 7:
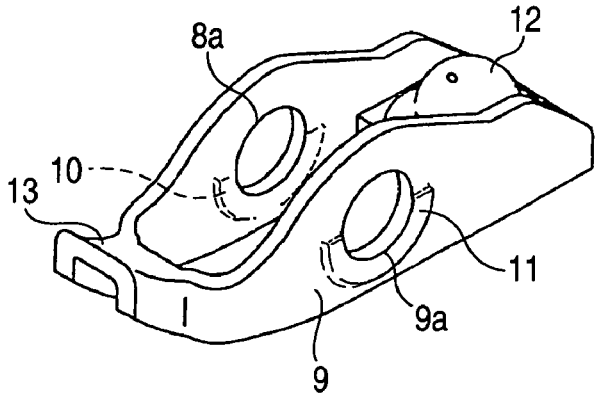
FIG. 7 is a perspective view of the simplex of the body of the rocker arm concerned with a further embodiment of the invention.

A further embodiment according to the invention will be explained with reference to FIG. 7. In the rocker arm 2 according to this embodiment, the thickened portions 10, 11 of the axial holes 8*a*, 9*a* of the body 4 are formed to be semicircular corresponding to a large loading range in response to load when serving the rocker arm 2. This rocker arm 2 can also perform similar working effects as that of the rocker arm 2 shown in FIGS. 1 to 3.

What is claimed is:

1. A rocker arm comprising:

a body that comprises sheet metal and includes a pair of side walls;

a pair of axial holes that are respectively formed through the pair of side walls and have a first diameter and through which an axis is inserted, wherein the pair of axial holes include thickened portions formed partially or overall of a circumference of the pair of axial holes, wherein the thickened portion is formed by expanding a hole that has a second diameter smaller than the first diameter and is formed in a pre-arranged range for forming the axial hole in a blank material so as to cause plastic flow in a metallic material of the circumference of the hole, and wherein the second diameter is smaller than a diameter of the axis of said rocker arm.

2. The rocker arm according to claim 1, wherein the thickened portion is formed at a portion of the circumference of the axial hole at sides of loading ranges.

3. The rocker arm according to claim 1, wherein only the thickened portion is projected from the side wall in a direction in which the axis is extended.

4. A method of manufacturing a rocker arm that includes a body that includes a pair of side walls, and a pair of axial holes that are respectively formed through the pair of side walls and have a first diameter and through which an axis is inserted, the method comprising:

forming a hole having a second diameter smaller than the first diameter in pre-arranged ranges of a blank material, said second diameter being smaller than a diameter of the axis of said rocker arm; and expanding the hole having the second diameter to form the axial hole having the first diameter so that a thickened portion is formed partially or overall of a circumference of the axial hole by causing plastic flow in a metallic material of the circumference.

5. A rocker arm that includes a body that includes a pair of side walls, and a pair of axial holes that are respectively formed through the pair of side walls and have a first diameter and through which an axis is inserted, produced by a method comprising:

forming a hole having a second diameter smaller than the first diameter in pre-arranged ranges of a blank material, said second diameter being smaller than a diameter of the axis of said rocker arm; and expanding the hole having the second diameter to form the axial hole having the first diameter so that a thickened portion is formed partially or overall of a circumference of the axial hole by causing plastic flow in a metallic material of the circumference.

6. The rocker arm according to claim 1, wherein the axis is bridged between said pair of side walls and non-rotatably attached to said side walls by fitting the axis to circumferential faces of said pair of axial holes.

7. The rocker arm according to claim 1, wherein the axis comprises expanding opposite end faces that are fitted to said thickened portions such that the axis does not project from said sidewalls.

8. The rocker arm according to claim 1, further comprising a lash adjuster formed at a second end of said body between said side walls.

9. The rocker arm according to claim 8, further comprising a valve carrier formed at a first end of said body.

10. The rocker arm according to claim 9, wherein said side walls, said lash adjuster carrier and said valve carrier comprise a single, integrated piece.

11. The rocker arm according to claim 1, wherein the thickness of said thickened portions comprise a thickness approximately 1.5 times a thickness of said side walls.

12. The rocker arm according to claim 1, further comprising a roller supported on the axis between said side walls.

13. The rocker arm according to claim 12, wherein said roller comprises a plurality of needle rollers turnably disposed along an inside surface of said roller.

14. The rocker arm according to claim 1, wherein said axial holes comprise an elliptical shape.

15. The rocker arm according to claim 1, wherein said axial holes comprise a semicircular shape.

16. The method according to claim 4, wherein said pre-arranged ranges are pre-arranged to ensure that the second diameter of said axial holes is smaller than a diameter of the axis.

* * * * *